US005873454A

United States Patent [19]

Nakamura

[11] Patent Number: 5,873,454

[45] Date of Patent: Feb. 23, 1999

[54] SHEET TYPE KEY TOP

[75] Inventor: Tsuyoshi Nakamura, Tokyo, Japan

[73] Assignee: Plymatech Co., Ltd., Tokyo, Japan

[21] Appl. No.: 967,749

[22] Filed: Nov. 10, 1997

[30] Foreign Application Priority Data

Dec. 6, 1996 [JP] Japan ..... 8-340429

[51] Int. Cl.[6] ..... H01H 3/12

[52] U.S. Cl. ..... 200/514; 200/308

[58] Field of Search ..... 29/622; 200/5 A, 200/512, 513, 516, 517, 341, 344, 345, 308, 310, 313, 314, 317; 400/490, 491.2, 494, 495

[56] References Cited

U.S. PATENT DOCUMENTS

| | | | |
|---|---|---|---|
| 4,395,817 | 8/1983 | Asada et al. | 29/622 |
| 4,937,408 | 6/1990 | Hattori et al. | 200/314 |
| 5,234,744 | 8/1993 | Kenmochi | 428/195 |
| 5,280,146 | 1/1994 | Inagaki et al. | 200/341 |
| 5,362,934 | 11/1994 | Inagaki et al. | 200/520 |
| 5,399,821 | 3/1995 | Inagaki et al. | 200/341 |
| 5,475,192 | 12/1995 | Inagaki et al. | 200/341 |
| 5,613,599 | 3/1997 | Inagaki et al. | 200/512 |

FOREIGN PATENT DOCUMENTS

| | | | |
|---|---|---|---|
| SHOWA 54-154461 | 12/1979 | Japan | B29D 19/02 |
| HEISEI 2-14726 | 1/1990 | Japan | H01H 13/06 |
| HEISEI 7-54656 | 6/1995 | Japan | H01H 13/06 |

*Primary Examiner*—Michael A. Friedhofer
*Attorney, Agent, or Firm*—McGlew and Tuttle

[57] ABSTRACT

A sheet type key top of a push button switch which is disposed over a switch contact used for the input portion of a portable electric appliance or a machine control portion or the like, and through which the underlying switch is depressed to turn it on or off. A film on key tops is formed with a multi layered elastic film (4), and a display portion printed layer (3) is completely covered with the protective layer (4). Then, thermoplastic fine powder (5) capable of heat fusing is added to the display portion print layer (3) and/or to the protective layer (4), thereby the film and the display portion are integrally united by heat fusing a thermoplastic substance constituting key tops and the thermoplastic fine powder through heat generated during molding process. Further, stress intercepting zones of concave or convex shapes are disposed at distances between adjacent keys to prevent error activation. Thereby the free design of the key top profile can be secured, the variety of the key top design can be attained, and further in the case of the case design of three dimensional configuration, the various design thereof can be also realized.

6 Claims, 3 Drawing Sheets

SHEET TYPE KEY TOP

FIELD OF THE INVENTION

The present invention relates to a sheet type key top of a push button switch which is disposed over a switch contact for using as an input portion of a portable electrical appliance or a machine control portion or the like, and more particularly to the sheet type key top of the push button switch turning on or off by depressing the switch contact from the upside thereof.

BACKGROUND OF THE INVENTION

As disclosed by Japan Utility Model Laid-Open No. HEISEI 2-14726 or the like, it is well known, in a structure of a push button switch, that the conventional film covering key tops composes of a sheet of film printing a display portion and a thermoplastic substance of the key top body produced by a molding, wherein a curvature portion having the same profile as the upper face of the key top body is disposed on the film and the upper face of the key top body is contained in the curvature portion so as to integrally unit the film with the key top body.

Further, as disclosed by the inspection of Japan Patent Laid-Open No. SHOWA 54-154461 and Japan Patent Publication No. HEISEI 7-54656, a manufacturing technology of key tops in which thermoplastic resin is buried into a resin film by injection molding, is also well known.

A structure of the push button switch as disclosed by Japan Utility Model Laid-Open No. HEISEI 2-14726, is characterized in its waterproofness, however it does not describe about chattering error key activation due to an insufficient glueing between the film and the key body which causes a problem for practical operation, an occurrence of wrong inputting due to operating together with adjacent keys, or materials and characteristics necessary for the film in accordance with a profile of the key body.

In the key top which is manufactured through a step of buring thermoplastic resin into resin film by means of injection molding as disclosed in Japan Patent Laid-Open No. SHOWA 54-154461 and Japan Patent Publication No. HEISEI 7-54656, resin is used as the film material. Therefore it has a disadvantage that the formation of a cavity with a sufficient depth is restricted, for example, in respect of the height and the shape of key which is important elements of a key top for portable telephone, the design of key shape for portable telephone is greatly limited, as clearly noted in Japan Patent Publication No. HEISEI 7-54656.

Further, as described in paragraph [0031] of Japan Patent Publication No. HEISEI 7-54656, the design of the case of a portable telephone is restricted in the height of key top, so said design cannot be applied for three dimensional configuration, as represented in perspective views from lateral face and bottom face sides in FIG. 4. To overcome the problem mentioned above, it is considered to arrange the film along the curved surface of a case face a as illustrated by FIG. 5, nevertheless the process has as well a limitation for the formation, because the film is formed with resin. As undue stress is applied to the film, the distortion of the keys is caused during the mounting. For the above reasons, an input portion of a portable telephone set is limited so as to be almost flat, so the whole design of the telephone set is resultingly restricted.

Furthermore, for instance, in a sheet type key top used for a portable telephone set, there is sometimes the case where the portable telephone set is left behind in a car, therein under the test of leaving it in a temperature atmosphere of 85° C. which is generally a standard test for car equipments, the sheet type key top is distorted by residual stress in the resin film to return to the state before molding, thereby the key top cannot accomplish sometimes the function of itself.

Still further, in the case where key top elements molded using an elastic film such as an elastomer film or the like are applied as an input portion, the key tops are scratched by fingernails during key operation, or when the user puts the set into his/her bag or the like, the surface of key top may be easily damaged because the elastic film lacks sufficient hardness, and may not look nice outer appearance. Furthermore if thermoplastic substance contained in the curvature portion of the film is composed of resin, the key top is enough hard, and is in the direction to be hard of said tendency. The key top feeling during the input operation to appliances is limited by the resin feeling, as the result, a soft feeling such as a rubber switch can not be achieved.

In an integral molding, when an adhesive is applied onto the film, when a display portion of characters or the like is printed, or when an adhesive layer is provided after printing the display portion on the film, there has been a known technology for preventing heat from spreading towards the printed portion during injection molding, but since the adhesive is applied during or after molding, it is required that the adhesive is unhardening, thus the elongation of the printed portion is caused in accordance with the stretching of film which is heated during injection molding. Accordingly, although the printed portion itself is relieved of heat, the stretching of film can not be ristricted, and the distortion or the elongation of printed display portion cannot be avoided. Therefore the restrictions of the conditions of injection molding and the profile of key top are unavoidable.

When two or more key tops are composed of resin film, or when the film end is fixed (adhered, bonded or held) with other member, suppose that one of keys is depressed on key operation. At that time, adjacent keys may be also activated together through being pulled in the direction of film pushing. At the same time, input operations of keys are acted, and there has been a problem of error activation of appliances or unachieving of a desired operation or the like.

SUMMARY OF THE INVENTION

It is objects of the present invention to provide a sheet type key top which comprises an elastic film structure having two or more layers on the upper face of key top and stress intercepting zones of convex or concave profiles disposed at distances between adjacent key tops. By this, a free design of key top profile is realized, the heat resistance of key top elements after molding is improved, and the stress generated on pushing a key does not affect the adjacent keys.

DETAILED DESCRIPTION OF THE PREFERRED EMBODIMENTS

Figure 1:
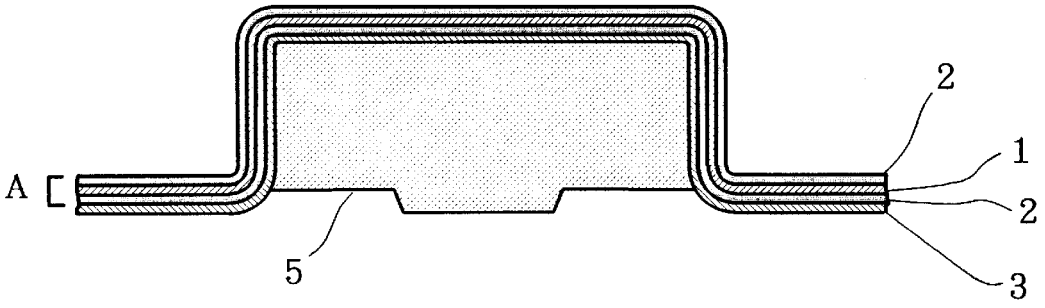
FIG. 1 is a schematic diagram representing the cross-section of a key top of the first Example.

In the present invention, thermoplastic films such as polyester thermoplastic film, polyolefin thermoplastic film, polystyrene thermoplastic film, polyurethane thermoplastic film, polyamide thermoplastic film, silicone thermoplastic film, 1,2-polybutadiene thermoplastic film, polyethylenevinyl acetate thermoplastic film, polyvinylchloride thermoplastic film, polyvinyl alcohol thermoplastic film, and thermoplastic elastomer films are used for film materials, and these are applied as a plural of layers for the film. While, for an object of preventing the damage of the key top surface caused by using an elastic film of thermoplastic elastomer film for the film materials, a multi layered elastic film having a structure of laminating a harder film than the elastic film which is a substance of one or both surfaces of elastic film of thermoelastic elastomer film is used. Such harder film than the elastic film substance includes polyamide film, polyethylenetelephthalate film, polypropylene film, polycarbonate film, polyvinyl chloride film, polyvinyl alcohol film, cellophane film, etc. The thermoplastic materials of the key top body include such thermoplastic substances as polycarbonate, polypropylene, polystyrene, polyacrylonitrilebutadienestyrene, polyurethane, polymethylmethacrylate, polyethylene telephthalate, polybuthyle telephthalete, acrilonitrilestylene, etc.

In the present invention, a multi layered film 4 made of above described materials is used, a display portion 3 is printed on containing side surface of a key top body 5 which composes of a thermoplastic resin formed by molding, thereafter a protective layer 4 is formed so as to wholly cover the printed display portion, as the need arises, for allowing stress to stretching toward other parts than the printed display portion in order to prevent the display portion from elongating due to a curvature deformation of the multi layered elastic film. Further, thermoplastic fine powders are added on the printed layer of the display portion and/or on the protective layer in order to be heat-bonded with a thermoplastic material of the key top body, so that, the multi layered elastic film and key top body are firmly bonded together and, separation of the adhesion between the multi layered elastic film and the thermoplastic materials which is caused due to the temperature and the humidity can be avoided.

Further, the stress generated on pushing a button switch influences on the key top, as the result, the error activation occurs on inputting or the desired operations or the like are not obtained sometimes. To prevent these obstacles, stress intercepting zones of concave or convex shapes are disposed at distances between key tops.

The profiling of the concave or convex shape can be formed simultaneously on molding of key top by adding a process to a metal die for key tops, or can be formed by means of jigs after molding key tops.

The film covering key top according to the present invention is produced by a well known producing technology. For example a manufacturing method of the sheet type key top comprises the step of forming the multi layered elastic film printed for a desired purpose in a curvature profile of a key top portion by means of metal die or jig, thereafter inserting into the metal die for molding key top body the multi layered elastic film formed in the key top curvature profile and molding the key top body by injecting resin.

A sheet type key tops can be also manufactured by the step of inserting the multi layered elastic film printed according to a desired propose into a metal die for molding the key top body, and deforming the multi layered elastic film in the curvature profile of the key top portion by heat or pressure of the fusion resin, when resin for the key top body is injected.

EXAMPLE [1]

The present invention will be described with reference to an embodiment illustrated in FIG. 1. A sheet type key tops is formed by steps of forming a multi layered elastic film A laminated nylon 2 on both surfaces of a polyester group thermoplastic elastomer film 1 in the shape of key top, inserting it into a metal die for molding a key top body and molding integrally a key top body by injecting thermoplastic polycarbonate 5 (Yupiron provided by Mitsubishi Enterprise) into the metal die by means of an injector.

As Comparison example [1], a film made up of monolayer elastic film of polyester thermoplastic elastomer film (Glylax film made by DIC Ltd.) is used, and as Comparison example [2], using monolayer resin film of polycarbonate film (Yupiron made by Mitsubishi Chemical Ltd.) a sheet type key top is produced in the same manner as in Example [1]. Each film having a thickness of 0.1 mm is used.

| Comparison of Products | | |
|---|---|---|
| Example [1] (multi layered elastic film) | film unruptured | capable of molding |
| Comparison example [1] (mono-layered film) | film unruptured | capable of molding |
| Comparison example [2] (mono-layered film) | film ruptured | molding impossible |

Figure 4:
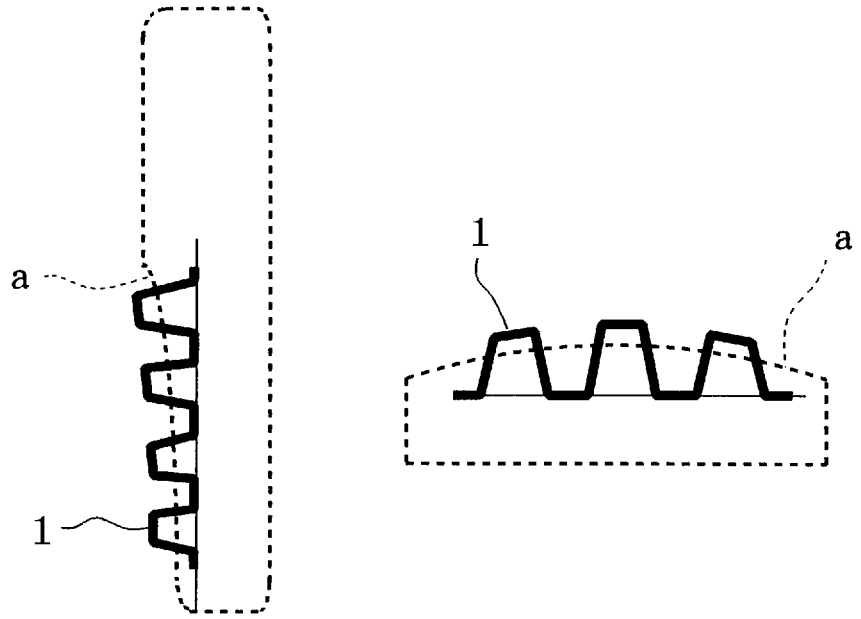
FIG. 4 is an outline view of a portable telephone set.

For the purpose of installing in the case of a telephone set, two kinds of molding type s are evaluated. Metal die (a) the same shape type as the rear surface of a case (three dimension configuration) (FIG. 4).

| | molded | reversal | mounting |
|---|---|---|---|
| Example [1] | according to the profile | NO | capable |
| Comparison [1] | according to the profile | NO | capable |
| Comparison [2] | distortions occur in the film after molding | the profile is reversed | impossible |

Figure 5:
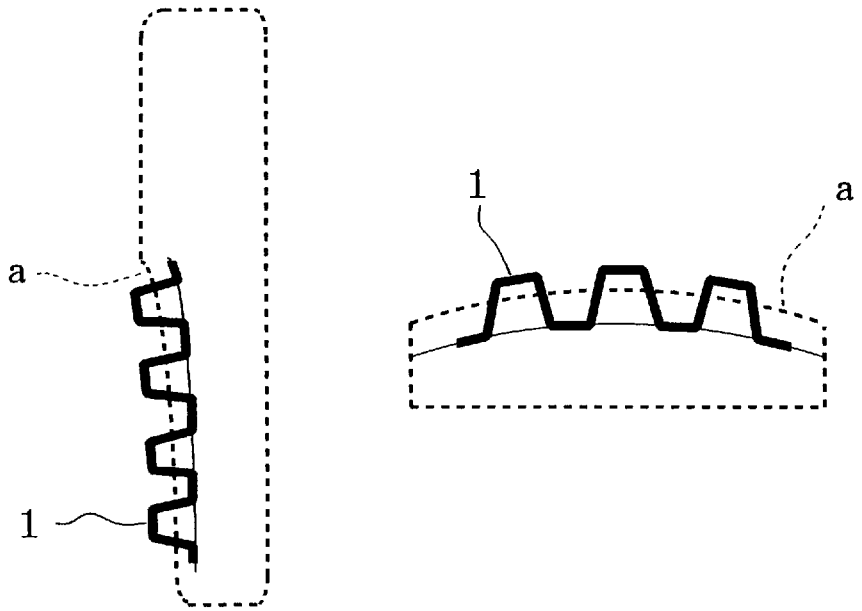
FIG. 5 is an outline view of another portable telephone set.

Metal die (b) forcibly flattened type (molding products molded in a flat installed in a case of three dimension configuration) (FIG. 5)

| | molding | fitting to the case profile |
|---|---|---|
| Example [1] | capable | capable |
| Comparison [1] | capable | capable |
| Comparison [2] | capable | unfitting due to inherent ridgidity of the film on inserting into the case of the three dimension configuration (different design). |

From above results it is obvious that the use of a laminated elastic film allows to realize a design of a key top shape which have been impossible up to now. A mono-layer elastic film can be also worked, but a problem will be cause in practice as shown by the following measurement.

Measurement of damage sensitivity of key top (JIS K 5400)

| | |
|---|---|
| Example [1] | a pencil, core bardness of 2H |
| Comparison [1] | a pencil, core hardness of 4B |

The use of multi layered elastic film A enhances the damage resistance of key top by pencil core hardness.

EXAMPLE [2]

Figure 2:
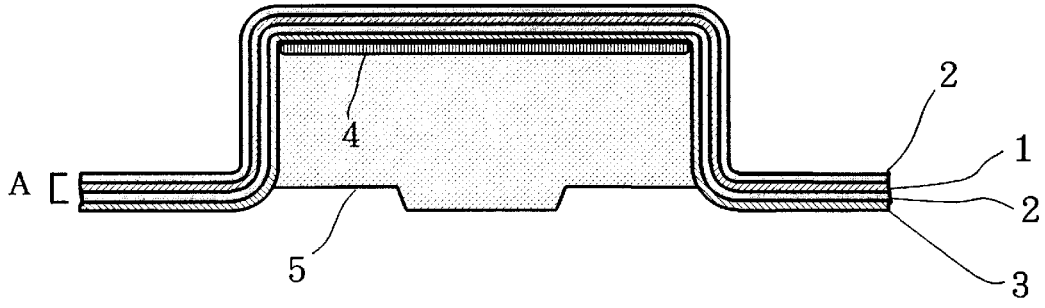
FIG. 2 is a cross-section view of a structure of the key top of the second Example of the present invention.

The present invention will be further described with reference to Example [2] as illustrated in FIG. 2.

A display portion 3 is printed on a multi layered elastic film A in Example [1] by a screen printing, a sheet of film bonded with nylon layer 4 as a reinforce layer is manufactured so as to cover the display portion only, and is integrally molded by means of injection molding using thermoplastic polycarbonate for the key top body 5 in the same manner as that in Example [1].

As Comparison [3], a display portion is printed on the resin film as used in Comparison [2] by a screen printing, and the film was also integrally molded by injection molding using thermoplastic polycarbonate for the key top body in the same manner as that in Example [2].

Distortion degree of characters (a grid of 1 mm×1 mm square is printed, evaluated by the size variation dispersion after molding)

| | the magnification of size variation | the variation dispersion | the difference |
|---|---|---|---|
| Example [2] | 1.7 to 1.8 | small | 0.1 point |
| Comparison [3] | 1.5 to 1.9 | large | 0.4 point. |

The distortion of grid can be restricted by using reinforcement of nylon film.

EXAMPLE [3]

Screen printing is applied on a multi layered elastic film A as prepared in Example [1] using urethane ink (EXG, made by Teikoku Ink Ltd.) supplemented with polycarbonate fine powder (Yupiron, made by Mitsubishi Engineer Plastics Ltd.) to provide a film thickness of 12 $\mu$m, and the resulting film was molded to a key top by injection molding using thermoplastic polycarbonate for the key top body in the same manner as that in Example [1].

Comparison [4] was prepared as follows: a display portion is printed on a resin film by screen printing, and the film was also molded to a key top by injection molding using thermoplastic polycarbonate for the key top body in the same manner as that in Example [3] mentioned above.

In hot temperature atmosphere, it was confirmed whether the thermoplastic substance contained in the curvature portion is separated from the film or not.

| | Hot temperature atmosphere | |
|---|---|---|
| | 100° C. | 80° C. |
| Example [1](multi layered film) | Fall of resin | NO |
| Example [3](adding fine powder) | NO | NO |
| Comparison [4](mono-layered film) | FALL | FALL |

In the case of the resin film used in Comparison [4], the resin of the key top body was fallen away therefrom since the surface profile of the key sheet is reversed in the temperature atmosphere 80° C. In the case of the multi layered elastic film A of Example [1], falling of the key top body was not found since the key sheet is not reversed in the temperature atmosphere 80° C. However, in the temperature atmosphere of 100° C., the key top body resin was fallen away. Addition of polycarbonate fine powder to the multi layered elastic film A of Example [3] prevents the resin from falling away even in temperature atmosphere of 100° C.

EXAMPLE 4

Figure 3:
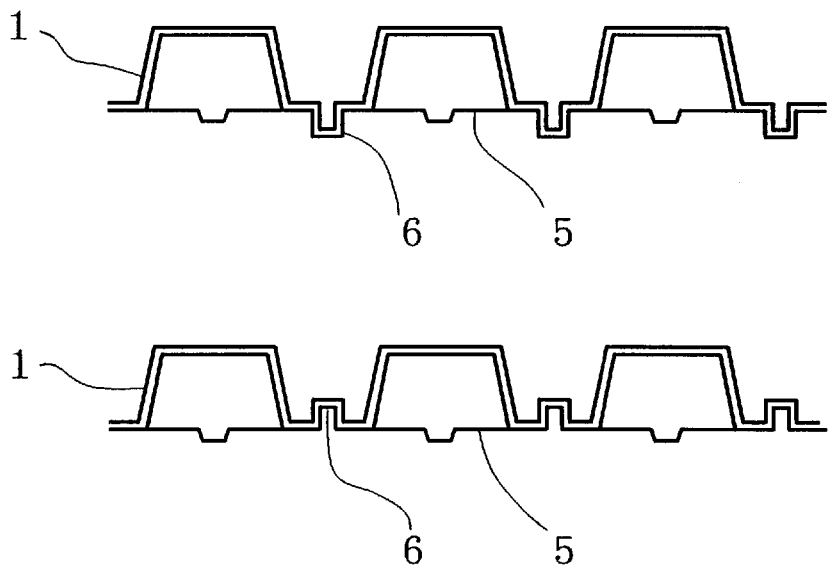
FIG. 3 is a cross-section view of key tops with stress interceptors inserted between adjacent key tops.

After forming of a sheet type key top, concave (a) or convex (b) stress intercepting zones 6 is processed by means of jig at distances between adjacent keys apart 0.2 mm from the circumference of key top as shown in FIG. 3.

These products are set to the case of a portable telephone to check the behavior of adjacent key tops when pushing a key top. As the result, key top formed with stress intercepting zones, no mechanical link was observed between a pushed key and its adjacent keys, while, in another key top with no stress intercepting zones, adjacent keys of the pushed key are disturbed.

By using a multi-layer elastic film, as film for the upper surface of a key top body, having the composition of two or more layers obtained by laminating one or both surfaces of an elastic film such as thermoplastic elastomer film with a film harder than the base elastic film, the height and shape of the key top can be designed more freely and further the elasticity of the film itself allows to enrich the variety of key top designing, to arrange as shown in FIG. 5 even for the case design of three dimension configuration, and also to enrich the variety of case designing. Moreover, even when it is left in a temperature atmosphere of 85° C. as specified by a general standard for car equipments, the deformation due to the heat can be restricted, be cause the elastic body dissipates the residual stress. The stress does not affect the adjacent key tops when it is pushed down, and what is more, the heat resistance of key top parts after molding can be expected to be improved.

By using a multi layer elastic film, the key top surface damage caused by the impact of nail during the entry or by the contact with a hard object when it is put in a bag or the like, provoking problems if an elastic film made of thermoplastic elastomer film is used, can be prevented to avoid the deterioration of its outer appearance and also the decline of water-proof or drip-proof effect caused when it is torn can be prevented.

As a protective layer is formed in a manner to completely cover the display portion print layer, the tensile stress can be exerted on other than the display portion and the elongation of the display portion according to the elongation of film due to the curvature deformation can be ristricted. In other words, the deformation of display portion is small in respect of the key shape.

By adding thermoplastic fine powder that can be heat fused with a thermoplastic material to be contained in the display portion print layer or the protective layer, the heat applied during the molding can fuse the thermoplastic material and the thermoplastic fine powder to unite them firmly and the resistance to the peeling-off of the multi-layer elastic film from the thermoplastic material of the key top body by a natural/human stress can be improved remarkably.

By disposing stress intercept zones of concave or convex shapes on the key top outer circumference of the multi-layer elastic film, the generation of input error activation of adjacent key tops by the stress when it is pushed down can be prevented, so the input operation reliability and, moreover, the equipment handling security can be improved.

What is claimed is:

1. A push button of a switch, the push button comprising:

a key body formed having a display side;

a film integrally united with said key body on said display side, said film including a display portion, said display portion including a printed indicia and conforming to said display side, said film being an elastic film and including a plurality of layers, said plurality of layers including a print layer including said display portion, said plurality of layers also including a protective layer on a side of said printed layer.

2. A push button according to claim 1, wherein;

said plurality of layers of said elastic film include one of polyolefin group thermoplastic film, polystyrene group thermoplastic film, polyurethane group thermoplastic film, polyamide group thermoplastic film, silicone group thermoplastic film, 1,2-polybutadiene group thermoplastic film, polyethylenevinyl acetate group thermoplastic film, polyvinyl chloride group thermoplastic film, and polyvinyl alcohol group thermoplastic film.

3. A push button according to claim 1, wherein said plurality of layers of said elastic film include one layer from the group of polyester group thermoplastic film, polyolefin group thermoplastic film, polystyrene group thermoplastic film, polyurethane group thermoplastic film, polyamide group thermoplastic film, silicone group thermoplastic film, 1,2-poly-butadiene group thermoplastic film, polyethylenevinyl acetate group thermoplastic film, polyvinyl chloride group thermoplastic film, and polyvinyl alcohol group thermoplastic film, said plurality of layers of said elastic film also including another layer from the group of polyamide film, polyethylenetelephthalate film, polypropylene film, polycarbonate film, polyvinyl chloride film, polyvinyl alcohol film, and cellophane film.

4. A push button in accordance with claim 1, further comprising:

thermoplastic powder added to said plurality of layers for bonding said plurality of layers together and for bonding said elastic film to said key body.

5. A push button of a switch, the push button comprising:

a key body formed of molded thermoplastic and having a display side;

a film integrally united with said key body on said display side, said film including a display portion, said display portion including a printed indicia positioned adjacent to said display side and conforming to said display side, said film being an elastic film including a plurality of layers, said plurality of layers including a print layer including said display portion with said indica being positioned on a side of said elastic film adjacent said display side, said plurality of layers also including a protective layer, said film including means for restricting elongation of said display portion.

6. A push button of a switch, the push button comprising:

a plurality of key bodies formed of molded thermoplastic, each of said plurality of key bodies having a display side;

a film integrally united with said key bodies on said display sides, said film including a display portion, said display portion including printed indicia positioned adjacent to said display sides and conforming to said display sides, said film being an elastic film including a plurality of layers;

stress intercepting zones positioned between said plurality of key bodies, said stress intercepting zones being of one of concave and convex shape.

* * * * *